US010569992B2

(12) United States Patent
Ishiguro

(10) Patent No.: US 10,569,992 B2
(45) Date of Patent: Feb. 25, 2020

(54) ELEVATOR APPARATUS

(71) Applicant: MITSUBISHI ELECTRIC CORPORATION, Chiyoda-ku (JP)

(72) Inventor: Hidetaka Ishiguro, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 193 days.

(21) Appl. No.: 15/736,062

(22) PCT Filed: Aug. 21, 2015

(86) PCT No.: PCT/JP2015/073601
§ 371 (c)(1),
(2) Date: Dec. 13, 2017

(87) PCT Pub. No.: WO2017/033238
PCT Pub. Date: Mar. 2, 2017

(65) Prior Publication Data

US 2018/0170711 A1 Jun. 21, 2018

(51) Int. Cl.
*B66B 1/34* (2006.01)
*B66B 5/16* (2006.01)
(Continued)

(52) U.S. Cl.
CPC ..... *B66B 5/16* (2013.01); *B66B 1/32* (2013.01); *B66B 5/0018* (2013.01);
(Continued)

(58) Field of Classification Search
CPC ..... B66B 5/16; B66B 1/32; B66B 5/0018; B66B 5/0031; B66B 5/0068; B66B 5/02
(Continued)

(56) References Cited

U.S. PATENT DOCUMENTS 4,923,055 A * 5/1990 Holland ..... B66B 1/32 187/287
5,773,771 A * 6/1998 Chatham ..... B66B 5/0075 187/276
(Continued)

FOREIGN PATENT DOCUMENTS

EP 2583928 A1 4/2013
JP 8-310759 A 11/1996
(Continued)

OTHER PUBLICATIONS

Korean Office Action dated Apr. 17, 2019 issued in corresponding Korean Application No. 10-2018-7007368, 8 pages (with English Translation).
International Search Report dated Nov. 17, 2015 in PCT/JP2015/073601 filed Aug. 21, 2015.

*Primary Examiner* — Anthony J Salata
(74) *Attorney, Agent, or Firm* — Xsensus LLP

(57) ABSTRACT

An elevator apparatus including a car, a brake device configured to brake running of the car, and an unintended car movement protection device. For the unintended car movement protection device, an allowable zone being a zone for allowing movement of the car under a door-open state is set. When the car moves out of the allowable zone under the door-open state, the unintended car movement protection device stops the car by the brake device. Further, the unintended car movement protection device is capable of changing a range of the allowable zone in accordance with a braking capability of the brake device.

20 Claims, 5 Drawing Sheets

(51) Int. Cl.
*B66B 5/02* (2006.01)
*B66B 5/00* (2006.01)
*B66B 1/32* (2006.01)

(52) U.S. Cl.
CPC ..... *B66B 5/0031* (2013.01); *B66B 5/0068* (2013.01); *B66B 5/02* (2013.01)

(58) Field of Classification Search
USPC ..... 187/247, 277, 281, 282, 283, 284, 291, 187/313, 316, 391, 393
See application file for complete search history.

(56) References Cited

U.S. PATENT DOCUMENTS 7,350,883 B2 * 4/2008 Hubbard ..... B66B 5/0018 187/393
7,775,330 B2 * 8/2010 Kattainen ..... B66B 5/04 187/393
7,909,145 B2 * 3/2011 Erny ..... B66D 5/08 187/393
8,272,482 B2 * 9/2012 Takahashi ..... B66B 1/32 187/393
8,365,873 B2 * 2/2013 Viita-Aho ..... B66B 5/0031 187/314
8,869,945 B2 * 10/2014 Harkonen ..... B66B 1/28 187/288
9,422,133 B2 * 8/2016 Rebillard ..... B66B 1/32
10,099,894 B2 * 10/2018 Roberts ..... B66B 1/28
10,179,718 B2 * 1/2019 Stolt ..... B66B 5/14
10,221,040 B2 * 3/2019 Madar ..... B66B 5/0031

FOREIGN PATENT DOCUMENTS

JP 2007137617 A 6/2007
JP 2011-42480 A 3/2011
JP 2014-51344 A 3/2014
JP 5516729 B2 4/2014
JP 2014-139106 A 7/2014

* cited by examiner

ELEVATOR APPARATUS

TECHNICAL FIELD

The present invention relates to an elevator apparatus including an unintended car movement protection device configured to prevent running of a car with door open.

BACKGROUND ART

In a related-art elevator system, a car velocity, an amount of movement of a car, and a floor reference position are detected by a detection device. A safety controller compares a result of detection by the detection device to an abnormality determination threshold value of the car velocity, which is set for a position of the car, to determine occurrence of an open-door running abnormality. Further, the safety controller calculates a landing reference position for landing of the car and a distance for determination from the landing reference position to the car position. The abnormality determination threshold value is set so as to decrease as the distance for determination increases. Further, the abnormality determination threshold value is set based on the car position and a deceleration for stopping the car at a predetermined position (see, for example, Patent Literature 1).

Further, in a related-art elevator apparatus, a braking capability check mode for checking a braking capability of a brake device under a state in which no passenger is present in the car is included in operation modes of an elevator control device. In the braking capability check mode, the car which is currently running at a rated velocity is brought to an emergency stop by the brake device so that a deceleration of the car and a braking distance are measured (see, for example, Patent Literature 2).

Further, a related-art characteristic evaluation device for an elevator brake automatically evaluates characteristics of the brake based on a running distance of the car over an interval between time points at each of which a derivative of the car velocity changes when the car is forcibly stopped, and transmits a result of the evaluation to a monitoring center (see, for example, Patent Literature 3).

Still further, in a related-art safety system for an elevator, detection plates are provided at specific positions in a hoistway. The car is provided with a car-position sensor configured to detect the detection plates. Distance information indicating the specific positions at which the detection plates are provided and an interval therebetween is stored in a database. A safety controller detects, based on an output from the car-position sensor, that the car position matches with the specific position. Further, the safety controller calculates the car velocity for each interval from elapsed time for each interval and the distance information, and compares the car velocity to an excessively large velocity determination curve (see, for example, Patent Literature 4).

CITATION LIST

Patent Literature

[PTL 1] JP 2014-139106 A
[PTL 2] JP 2011-42480 A
[PTL 3] JP 8-310759 A
[PTL 4] JP 2014-51344 A

SUMMARY OF THE INVENTION

Problem to be Solved by the Invention

When it is determined that the braking capability of the brake device has decreased to such a level that functions of an unintended car movement protection device are not sufficiently fulfilled, the related-art elevator apparatus stops an operation of the car until the braking capability is restored to a proper level. Thus, serviceability of the elevator apparatus decreases.

The present invention has been made to solve the problem described above, and has an object to provide an elevator apparatus capable of reducing the number of stops of an operation of a car due to a decrease in braking capability of a brake device as much as possible to prevent a decrease in serviceability.

Means for Solving the Problem

According to one embodiment of the present invention, there is provided an elevator apparatus, including: a car; a brake device configured to brake running of the car; and an unintended car movement protection device in which an allowable zone being a zone for allowing movement of the car in a door-open state is set, the unintended car movement protection device being configured to stop the car by the brake device when the car moves out of the allowable zone under the door-open state, the unintended car movement protection device being capable of changing a range of the allowable zone in accordance with a braking capability of the brake device.

Further, according to one embodiment of the present invention, there is provided an elevator apparatus, including: a car; a brake device configured to brake running of the car; and an unintended car movement protection device configured to stop the car by the brake device when a car velocity becomes equal to or higher than a monitoring reference velocity under a state in which the car is in a door-open state, the unintended car movement protection device being capable of changing the monitoring reference velocity in accordance with the braking capability of the brake device.

Effects of the Invention

In the elevator apparatus according to the present invention, the range of the allowable zone set for the unintended car movement protection device can be changed in accordance with the braking capability of the brake device. Thus, when the braking capability of the brake device decreases, the range of the allowable zone is narrowed. As a result, the number of stops of the operation of the car due to the decrease in braking capability of the brake device is reduced as much as possible, and hence the decrease in serviceability can be prevented.

Further, the elevator apparatus according to the present invention, the monitoring reference velocity set for the unintended car movement protection device can be changed in accordance with the braking capability of the brake device. Thus, when the braking capability of the brake device decreases, the monitoring reference velocity is reduced. As a result, the number of stops of the operation of the car due to the decrease in braking capability of the brake device is reduced as much as possible, and hence the decrease in serviceability can be prevented.

DESCRIPTION OF EMBODIMENTS

Now, embodiments of the present invention are described with reference to the drawings.

First Embodiment

Figure 1:
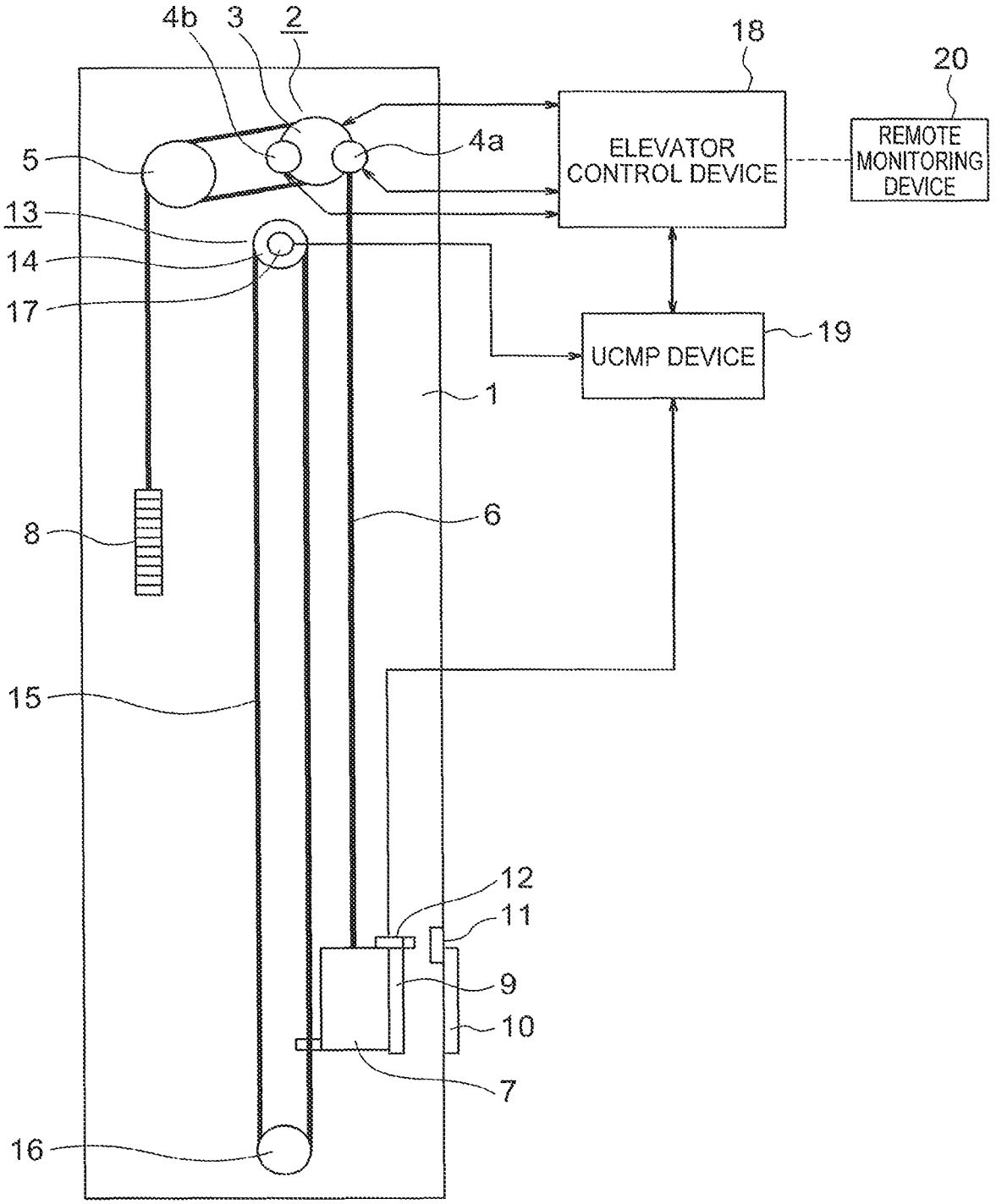
FIG. 1 is a configuration diagram partially in blocks for illustrating an elevator apparatus according to a first embodiment of the present invention.

FIG. 1 is a configuration diagram partially in blocks for illustrating an elevator apparatus according to a first embodiment of the present invention. In FIG. 1, a traction machine 2 is installed in an upper part of a hoistway 1. The traction machine 2 includes a driving sheave 3, a traction machine motor (not shown) configured to rotate the driving sheave 3, and a pair of brake devices 4*a* and 4*b* configured to brake the rotation of the driving sheave 3.

In the upper part of the hoistway 1, a deflector sheave 5 is installed at a distance from the driving sheave 3. A suspending body 6 is wound around the driving sheave 3 and the deflector sheave 5. As the suspending body 6, a plurality of ropes or a plurality of belts are used.

A car 7 is connected to a first end portion of the suspending body 6. A counterweight 8 is connected to a second end portion of the suspending body 6. The car 7 and the counterweight 8 are suspended by the suspending body 6 inside the hoistway 1, and are raised and lowered inside the hoistway 1 by rotating the driving sheave 3. The brake devices 4*a* and 4*b* brake running of the car 7 by braking the rotation of the driving sheave 3.

On a front surface of the car 7, a car-door device 9 configured to open and close a car doorway is mounted. A landing-door device 10 configured to open and close a landing doorway is provided to a landing of each of a plurality of stop floors. Inside the hoistway 1, a plurality of detection members 11 are installed. In FIG. 1, one landing-door device 10 and one detection member 11 are illustrated for each for simplification. Each of the detection members 11 is arranged at a position corresponding to a releveling zone on a corresponding one of the stop floors. On an upper surface of the car 7, a zone detection device 12 configured to detect the detection member 11 is mounted.

The releveling zone is set to a range smaller than a door zone being a region in which door opening is allowed. Inside the hoistway, a plurality of landing plates (not shown) corresponding to the door zone are installed.

In the upper part of the hoistway 1, a speed governor 13 is installed. The speed governor 13 includes a speed-governor sheave 14. A speed-governor rope 15 is wound around the speed-governor sheave 14. The speed-governor rope 15 is laid in an annular manner inside the hoistway 1, and is connected to the car 7. Further, the speed-governor rope 15 is wound around a tension sheave 16 arranged in a lower part of the hoistway 1.

The speed-governor sheave 14 is rotated along with the raising and lowering of the car 7. Specifically, when the car 7 is raised and lowered, the speed-governor rope 15 is moved in a circulating manner to rotate the speed-governor sheave 14 at a rotation speed in accordance with a running velocity of the car 7.

The speed-governor sheave 14 is provided with a car-position detection device 17 configured to generate a signal in accordance with the movement of the car 7. As the car-position detection device 17, for example, an encoder or a resolver, which generates a signal in accordance with the rotation of the speed-governor sheave 14, is used.

An operation of the car 7 is controlled by an elevator control device 18. The elevator control device 18 detects a position and a car velocity of the car 7 from a signal output from the car-position detection device 17 or other detection devices (for example, an encoder or a resolver configured to detect the rotation of the driving sheave 3).

Further, the elevator control device 18 performs a releveling operation when a door-open state is achieved after the car 7 lands on the stop floor. The elevator control device 18 corrects a vertical displacement of a car floor, which is caused by boarding and exiting of a passenger, to set the car floor back to a leveled position through the releveling operation.

Signals from the zone detection device 12 and the car-position detection device 17 are transmitted to an unintended car movement protection device (UCMP device) 19. In the unintended car movement protection device 19, an allowable zone being a zone for allowing the movement of the car 7 even under the door-open state is set. In this example, a releveling zone is set as the allowable zone.

When the car 7 moves out of the releveling zone being the allowable zone during a period in which the releveling operation for the car 7 is performed under the door-open state, the unintended car movement protection device 19 shuts off a power of the traction machine 2 by a relay or the like so that the car 7 is stopped by the brake devices 4*a* and 4*b*.

Further, when the car velocity becomes equal to or higher than a monitoring reference velocity during the period in which the releveling operation for the car 7 is performed under the door-open state, the unintended car movement protection device 19 shuts off the power of the traction machine 2 by a relay or the like so that the car 7 is stopped by the brake devices 4*a* and 4*b*.

Operation modes of the elevator control device 18 for the car 7 include a brake inspection mode. In the brake inspection mode, the elevator control device 18 inspects a braking capability (brake torque) of the brake devices 4*a* and 4*b* under a state in which no passenger is present in the car 7. Specifically, the elevator control device 18 of the first embodiment also serves as a brake inspection device.

Figure 2:
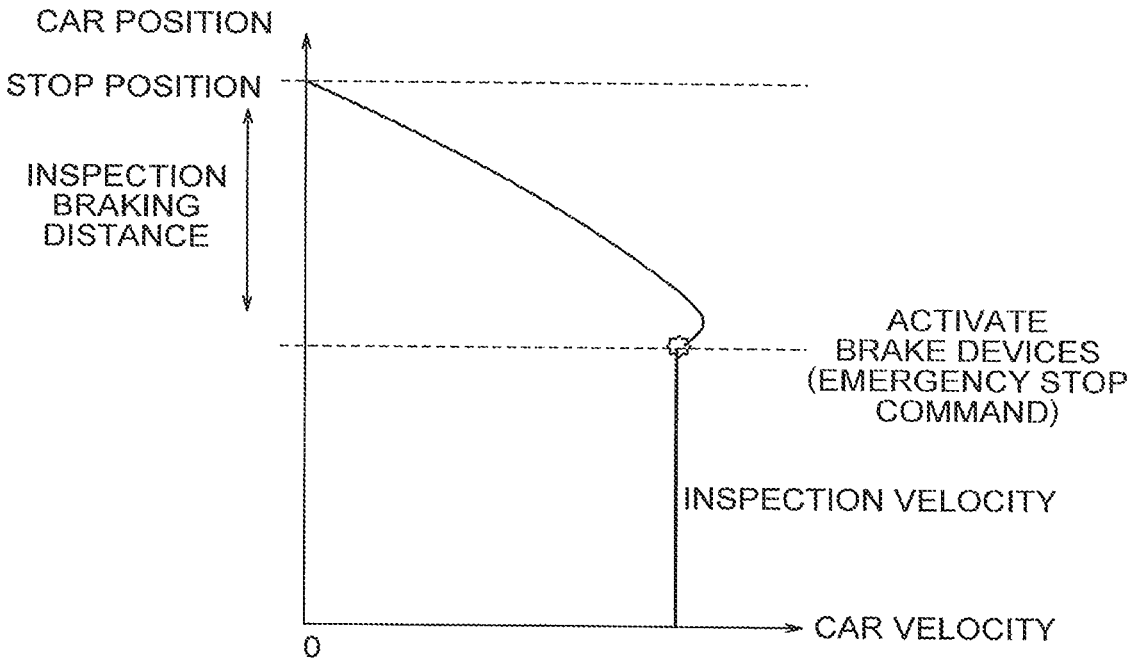
FIG. 2 is a graph for showing an example of a relationship between a car velocity and a car position during an inspection of a braking capability of brake devices illustrated in FIG. 1.

In the brake inspection mode, as illustrated in FIG. 2, after causing the car 7 to run at an inspection velocity (for example, rated velocity), the elevator control device 18 activates the brake devices 4*a* and 4*b* to bring the car 7 to an emergency stop. Then, an inspection braking distance being a distance of movement of the car 7 from the activation of the brake devices 4*a* and 4*b* to the stop of the car 7 is measured.

Further, after automatically inspecting the braking capability of the brake devices 4*a* and 4*b* at set timing and detecting a decrease in braking capability of the brake devices 4*a* and 4*b*, the elevator control device 18 automatically issues an alarm to a remote monitoring device 20 of a maintenance engineer.

Further, the elevator control device 18 transmits information relating to the braking capability of the brake devices 4*a* and 4*b* to the unintended car movement protection device 19. The elevator control device 18 and the unintended car movement protection device 19 include independent computers, respectively, and are mutually communicable with each other.

Figure 3:
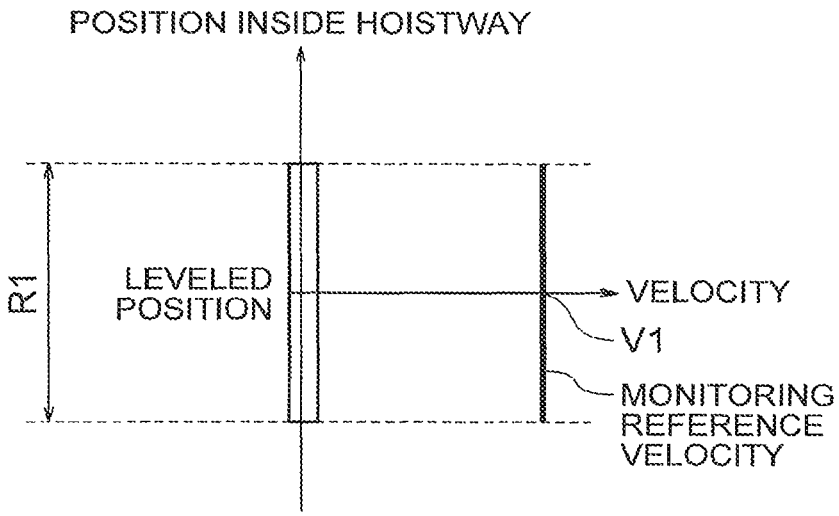
FIG. 3 is a graph for showing a first range of a releveling zone set for an unintended car movement protection device illustrated in FIG. 1.
Figure 4:
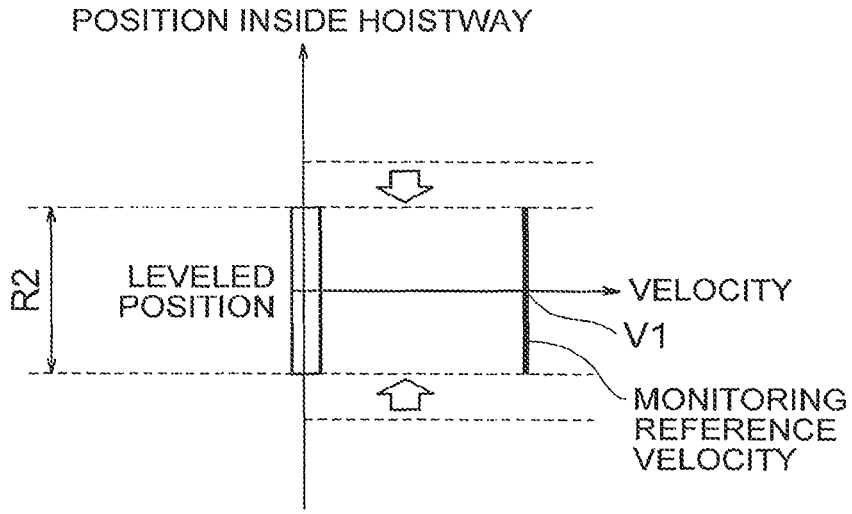
FIG. 4 is a graph for showing a second range of the releveling zone set for the unintended car movement protection device illustrated in FIG. 1.

The unintended car movement protection device 19 can change the range of the releveling zone in accordance with the braking capability of the brake devices 4*a* and 4*b*. In the unintended car movement protection device 19, a first range R1 illustrated in FIG. 3 and a second range R2 illustrated in FIG. 4 are set as the range of the releveling zone. The second range R2 is smaller than the first range R1 (R1>R2). Further, the second range R2 is a range obtained by equally decreasing the first range R1 vertically.

The unintended car movement protection device 19 sets the range of the releveling zone to the first range R1 when the braking capability of the brake devices 4*a* and 4*b* is equal to or larger than a preset threshold value, and changes the range of the releveling zone to the second range R2 when the braking capability of the brake devices 4*a* and 4*b* becomes smaller than the threshold value. Specifically, a value of an inspection result indicating the braking capability, for example, the inspection braking distance is compared to the threshold value. In this case, however, the value of the inspection result is referred to as "braking capability" for simplification.

Further, after the braking capability of the brake devices 4*a* and 4*b* becomes equal to or larger than the threshold value again, the unintended car movement protection device 19 sets the range of the releveling zone from the second range R2 back to the first range R1.

In the elevator apparatus described above, the range of the releveling zone set for the unintended car movement protection device 19 can be changed in accordance with the braking capability of the brake devices 4*a* and 4*b*. Therefore, when the braking capability of the brake devices 4*a* and 4*b* decreases, the range of the releveling zone can be narrowed.

In this manner, even when open-door running occurs under a state in which the braking capability of the brake devices 4*a* and 4*b* decreases by some degrees, the car 7 can be stopped within the allowable range. Therefore, the number of stops of the operation of the car 7 due to the decrease in braking capability of the brake devices 4*a* and 4*b* can be reduced as much as possible, and hence a decrease in serviceability can be prevented.

Figure 5:
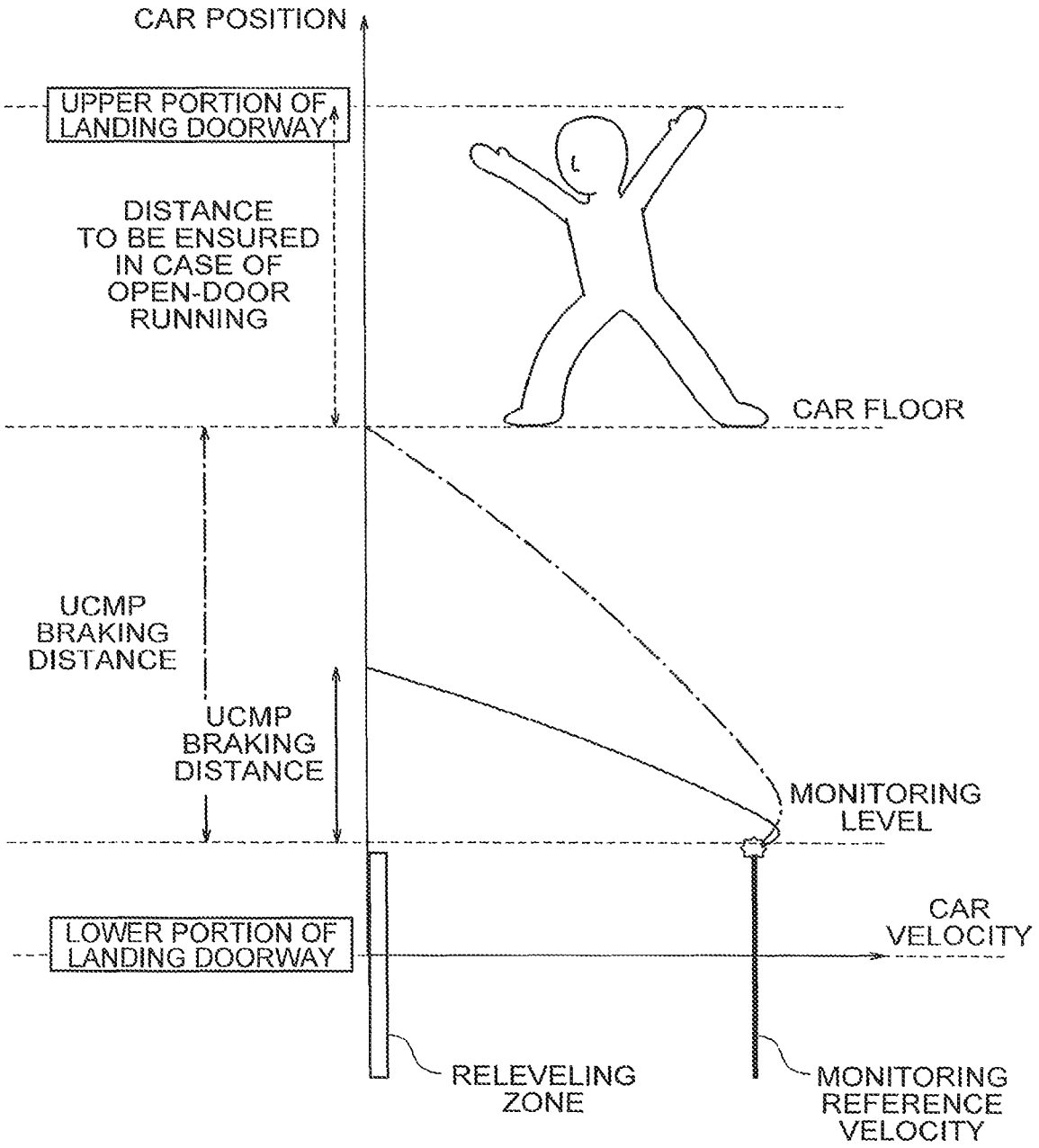
FIG. 5 is an explanatory diagram for illustrating an example of a change in braking distance during running with door open due to a decrease in braking capability.

FIG. 5 is an explanatory diagram for illustrating a change in braking distance due to the decrease in braking capability when the car 7 runs upward with door open. Due to the decrease in braking capability of the brake devices 4*a* and 4*b*, the braking distance of the car 7 from a time at which the unintended car movement protection device 19 detects the open-door running is increased from a distance indicated by the solid line to a distance indicated by the dashed line. In this manner, a distance between an upper portion of the landing doorway to the car floor is reduced.

Meanwhile, the range of the releveling zone is narrowed in accordance with the decrease in braking capability as in the first embodiment. As a result, the open-door running can be determined in an early stage so as to activate the brake devices 4*a* and 4*b* at early time. Therefore, even in a case where the braking distance is increased, an overlap between the car doorway and the landing doorway at a time when the car 7 is stopped can be sufficiently ensured.

Further, when the braking capability of the brake devices 4*a* and 4*b* is equal to or larger than the threshold value, the range of the releveling zone is set to the first range R1. When the braking capability of the brake devices 4*a* and 4*b* becomes smaller than the threshold value, the range of the releveling zone is changed to the second range R2. Therefore, the number of stops of the operation of the car 7 due to the decrease in braking capability of the brake devices 4*a* and 4*b* can be reduced as much as possible by simple control.

Further, when the braking capability of the brake devices 4*a* and 4*b* becomes equal to or larger than the threshold value again, the range of the releveling zone is set from the second range R2 back to the first range R1. Therefore, after the braking capability is restored to a normal level through adjustment or replacement of the brake devices 4*a* and 4*b*, a normal service can be smoothly restarted.

Still further, after the inspection of the braking capability of the brake devices 4*a* and 4*b* is automatically carried out at the set timing and the decrease in braking capability of the brake devices 4*a* and 4*b* is detected, an alarm is automatically issued to the monitoring device of the maintenance engineer. Therefore, a maintenance plan for the brake devices 4*a* and 4*b* can be built at early time or can be shortened.

Although the unintended car movement protection device 19 receives the information relating to the braking capability of the brake devices 4*a* and 4*b* from the elevator control device 18 to automatically change the range of the releveling zone in the first embodiment, the range of the releveling zone may be switched manually.

Further, although only one threshold value is set for the braking capability in the first embodiment, two or more threshold values and three or more ranges of the releveling zone may be set so that the range of the releveling zone is narrowed in a stepwise manner in accordance with the degree of decrease in braking capability.

Further, although the threshold value is set for the braking capability so that the range of the releveling zone is changed in a stepwise manner in the first embodiment, the range of the releveling zone can be changed continuously in a stepless manner in accordance with the braking capability.

Still further, in a case where the releveling zone is detected by using the detection members, for example, the detection member corresponding to the changed releveling zone is additionally provided. As a result, two or more releveling zones having different ranges can be detected. Further, the changed releveling zone can also be detected based on a combination of the signal from the zone detection device 12 and the signal from the car-position detection device 17.

Further, the unintended car movement protection device may detect the releveling zone based on a combination of a signal from an absolute-position detection device (for example, a switch which is operated by the movement of the car) configured to detect an absolute position inside the hoistway and a signal from a movement-amount detection device (for example, the car-position detection device 17) configured to generate a signal in accordance with the movement of the car without using the detection members 11.

Further, although the releveling zone is used as the allowable zone in the first embodiment, the present invention is also applicable to an elevator apparatus which does not perform the releveling operation. In this case, the allowable zone only needs to be suitably set to extend above and below the landing position on the stop floor.

Second Embodiment

Next, a second embodiment of the present invention is described. An overall configuration of an elevator apparatus of the second embodiment is identical or similar to that of the first embodiment (FIG. 1). However, the unintended car movement protection device 19 of the second embodiment can change the monitoring reference velocity in accordance with the braking capability of the brake devices 4*a* and 4*b*.

Figure 6:
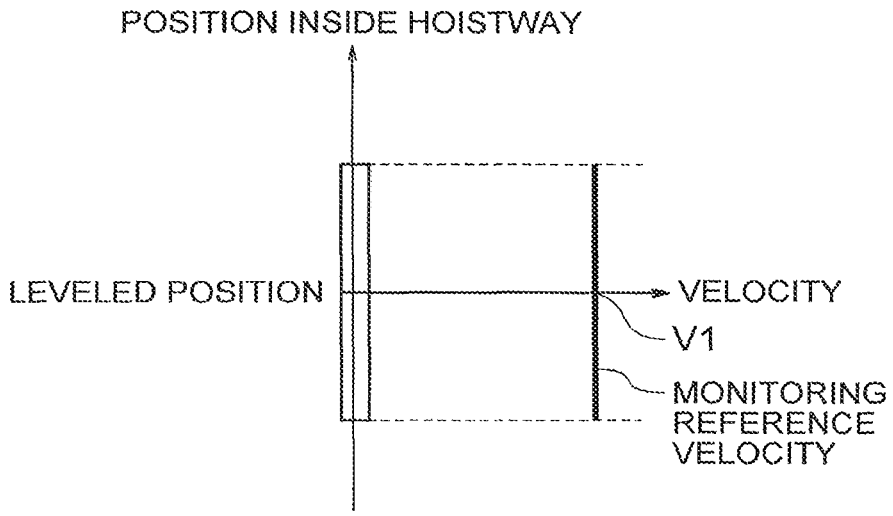
FIG. 6 is a graph for showing a first monitoring reference velocity set for an unintended car movement protection device for an elevator apparatus according to a second embodiment of the present invention.
Figure 7:
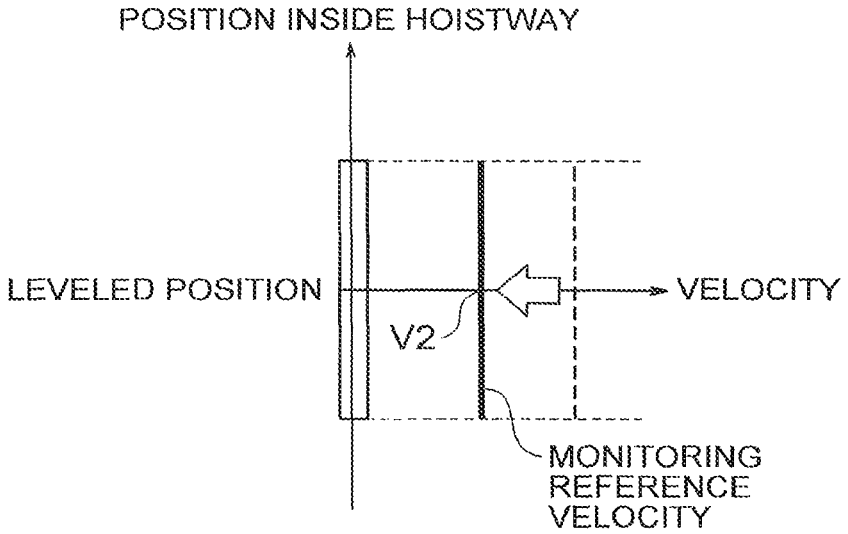
FIG. 7 is a graph for showing a second monitoring reference velocity set for the unintended car movement protection device of the second embodiment.

In the unintended car movement protection device 19, a first monitoring reference velocity V1 shown in FIG. 6 and a second monitoring reference velocity V2 shown in FIG. 7 are set as the monitoring reference velocity. The second monitoring reference velocity V2 is lower than the first monitoring reference velocity V1 (V1>V2).

The unintended car movement protection device 19 sets the monitoring reference velocity to the first monitoring reference velocity V1 when the braking capability of the brake devices 4*a* and 4*b* is equal to or larger than the preset threshold value, and changes the monitoring reference velocity to the second monitoring reference velocity V2 when the braking capability of the brake devices 4*a* and 4*b* becomes smaller than the threshold value. Further, when the braking capability of the brake devices 4*a* and 4*b* decreases to be smaller than the threshold value, the unintended car movement protection device 19 outputs a command to decrease the car velocity during the releveling operation to the elevator control device 18.

Further, when the braking capability of the brake devices 4*a* and 4*b* becomes equal to or larger than the threshold value again, the unintended car movement protection device 19 sets the monitoring reference velocity from the second monitoring reference velocity V2 back to the first monitoring reference velocity V1. Further, when the braking capability of the brake devices 4*a* and 4*b* becomes equal to or larger than the threshold value again, the unintended car movement protection device 19 outputs a command to set the car velocity during the releveling operation back to the velocity before change to the elevator control device 18. The remaining configuration and operation are identical or similar to those of the first embodiment.

In the elevator apparatus described above, the monitoring reference velocity in the unintended car movement protection device 19 can be changed in accordance with the braking capability of the brake devices 4*a* and 4*b*. Thus, when the braking capability of the brake devices 4*a* and 4*b* decreases, the monitoring reference velocity can be decreased.

In this manner, even when the door-opening running occurs under a state in which the braking capability of the brake devices 4*a* and 4*b* decreases to some extent, the car 7 can be stopped within the allowable range. Therefore, the number of stops of the operation of the car 7 due to the decrease in braking capability of the brake devices 4*a* and 4*b* is reduced as much as possible, and hence the decrease in serviceability can be prevented.

Further, when the braking capability of the brake devices 4*a* and 4*b* is equal to or larger than the threshold value, the monitoring reference velocity is set to the first monitoring reference velocity V1. When the braking capability of the brake devices 4*a* and 4*b* becomes smaller than the threshold value, the monitoring reference velocity is changed to the second monitoring reference velocity V2. Thus, the number of stops of the operation of the car 7 due to the decrease in braking capability of the brake devices 4*a* and 4*b* can be reduced as much as possible by simple control.

Further, when the braking capability of the brake devices 4*a* and 4*b* becomes equal to or larger than the threshold value again, the monitoring reference velocity is set from the second monitoring reference velocity V2 back to the first monitoring reference velocity V1. Thus, after the braking capability is restored to the normal level through the adjustment or replacement of the brake devices 4*a* and 4*b*, the normal service can be smoothly restarted.

Still further, when the braking capability of the brake devices 4*a* and 4*b* decreases, the command to decrease the car velocity during the releveling operation is output to the elevator control device 18. Thus, even when the open-door running occurs under the state in which the braking capability of the brake devices 4*a* and 4*b* decreases, the car 7 can be more reliably stopped. Further, in a case where the braking capability of the brake devices 4*a* and 4*b* decreases, the monitoring reference velocity can be set sufficiently low.

Further, when the braking capability of the brake devices 4*a* and 4*b* is restored to be equal to or larger than the threshold value, the command to set the car velocity during the releveling operation back to the velocity before change is output to the elevator control device 18. Thus, after the braking capability is restored to the normal level, time of the releveling operation can be shortened.

Although the unintended car movement protection device 19 receives the information relating to the braking capability of the brake devices 4*a* and 4*b* from the elevator control device 18 to automatically change the monitoring reference velocity in the second embodiment, the range of the monitoring reference velocity can be switched manually.

Further, although only one threshold value is set for the braking capability in the second embodiment, two or more threshold values and three or more monitoring reference velocities may be set so that the monitoring reference velocity may be decreased in a stepwise manner in accordance with the degree of decrease in braking capability.

Further, although the threshold value is set for the braking capability and the monitoring reference velocity is changed in a stepwise manner in the second embodiment, the monitoring reference velocity can be continuously changed in a stepless manner in accordance with the braking capability.

Still further, the releveling zone is used as the allowable zone in the second embodiment, the present invention is also applicable to an elevator apparatus which does not perform the releveling operation.

Further, the first embodiment and the second embodiment may be carried out in combination. Specifically, the range of the releveling zone and the monitoring reference velocity may be both changed in accordance with the decrease in braking capability of the brake devices 4*a* and 4*b*.

Further, for the threshold value in the first embodiment and the second embodiment, the inspection braking distance which is detected at the time of inspection with the braking capability to achieve the braking distance allowed by the unintended car movement protection device is prestored so as to be available as a threshold value for a subsequent inspection.

Still further, although the inspection of the braking capability of the brake devices is automatically carried out in the first embodiment and the second embodiment, a command may be input manually to carry out the inspection.

Although the two brake devices 4*a* and 4*b* are used in the above-mentioned example, the number of brake devices may be one or three or more.

Further, although the brake devices 4*a* and 4*b* provided to the traction machine 2 are described as the brake devices which are operated in response to the command from the unintended car movement protection device 19 in the example described above, a brake device arranged at another location such as, for example, a brake device configured to grip the suspending body 6 may be used.

Still further, although the elevator control device 18 also serves as the brake inspection device in the example described above, the brake inspection device may be independent of the elevator control device 18.

Further, although the unintended car movement protection device 19 is independent of the elevator control device 18 in the example described above, the two devices may be integrated with each other so that functions of the two devices may be implemented by a common computer.

Further, although the car-position detection device 17 is provided to the speed governor 13 in the example described above, the car-position detection device may be, for example, the encoder or the resolver, which is provided to the traction machine.

Still further, a layout of the entire elevator apparatus is not limited to a layout illustrated in FIG. 1. The present invention is also applicable to, for example, a two-to-one roping elevator apparatus, and an elevator apparatus including a traction machine arranged in a lower part of the hoistway.

Further, the present invention is applicable to all types of elevator apparatus including an elevator apparatus having a machine room, a machine room-less elevator, a double-deck elevator, and a one-shaft multi-car system elevator including a plurality of cars arranged in a common hoistway.

The invention claimed is:

1. An elevator apparatus, comprising:

a car;

a brake device configured to brake running of the car; and an unintended car movement protection device in which an allowable zone being a zone for allowing movement of the car in a door-open state is set, the unintended car movement protection device being configured to stop the car by the brake device when the car moves out of the allowable zone under the door-open state, wherein the unintended car movement protection device is configured to be capable of changing a range of the allowable zone in accordance with a braking capability of the brake device.

2. The elevator apparatus according to claim 1, wherein a first range and a second range smaller than the first range are set as the range of the allowable zone in the unintended car movement protection device, and the unintended car movement protection device sets the range of the allowable zone to the first range when the braking capability of the brake device is equal to or larger than a threshold value, and changes the range of the allowable zone to the second range when the braking capability of the brake device becomes smaller than the threshold value.

3. The elevator apparatus according to claim 2, wherein the unintended car movement protection device sets the range of the allowable zone back to the first range when the braking capability of the brake device becomes equal to or larger than the threshold value again.

4. An elevator apparatus, comprising:

a car;

a brake device configured to brake running of the car; and an unintended car movement protection device configured to stop the car by the brake device when a car velocity becomes equal to or higher than a monitoring reference velocity under a state in which the car is in a door-open state, wherein the unintended car movement protection device is configured to be capable of changing the monitoring reference velocity in accordance with the braking capability of the brake device.

5. The elevator apparatus according to claim 4, wherein a first monitoring reference velocity and a second monitoring reference velocity lower than the first monitoring reference velocity are set as the monitoring reference velocity in the unintended car movement protection device, and the unintended car movement protection device sets the monitoring reference velocity to the first monitoring reference velocity when the braking capability of the brake device is equal to or larger than a threshold value, and changes the monitoring reference velocity to the second monitoring reference velocity when the braking capability of the brake device becomes smaller than the threshold value.

6. The elevator apparatus according to claim 5, wherein the unintended car movement protection device sets the monitoring reference velocity back to the first monitoring reference velocity when the braking capability of the brake device becomes equal to or larger than the threshold value again.

7. The elevator apparatus according to claim 4, wherein, when the braking capability of the brake device decreases, the unintended car movement protection device outputs a command to decrease the car velocity during a releveling operation.

8. The elevator apparatus according to claim 7, wherein, when the braking capability of the brake device is restored, the unintended car movement protection device outputs a command to set the car velocity during the releveling operation back to the car velocity before change.

9. The elevator apparatus according to claim 1, further comprising a brake inspection device configured to automatically inspect the braking capability of the brake device at set timing and to automatically issue an alarm to a monitoring device of a maintenance engineer when a decrease in braking capability of the brake device is detected.

10. The elevator apparatus according to claim 5, wherein, when the braking capability of the brake device decreases, the unintended car movement protection device outputs a command to decrease the car velocity during a releveling operation.

11. The elevator apparatus according to claim 6, wherein, when the braking capability of the brake device decreases, the unintended car movement protection device outputs a command to decrease the car velocity during a releveling operation.

12. The elevator apparatus according to claim 10, wherein, when the braking capability of the brake device is restored, the unintended car movement protection device outputs a command to set the car velocity during the releveling operation back to the car velocity before change.

13. The elevator apparatus according to claim 11, wherein, when the braking capability of the brake device is restored, the unintended car movement protection device outputs a command to set the car velocity during the releveling operation back to the car velocity before change.

14. The elevator apparatus according to claim 2, further comprising a brake inspection device configured to automatically inspect the braking capability of the brake device at set timing and to automatically issue an alarm to a monitoring device of a maintenance engineer when a decrease in braking capability of the brake device is detected.

15. The elevator apparatus according to claim 3, further comprising a brake inspection device configured to automatically inspect the braking capability of the brake device at set timing and to automatically issue an alarm to a monitoring device of a maintenance engineer when a decrease in braking capability of the brake device is detected.

16. The elevator apparatus according to claim 4, further comprising a brake inspection device configured to automatically inspect the braking capability of the brake device at set timing and to automatically issue an alarm to a monitoring device of a maintenance engineer when a decrease in braking capability of the brake device is detected.

17. The elevator apparatus according to claim 5, further comprising a brake inspection device configured to automatically inspect the braking capability of the brake device at set timing and to automatically issue an alarm to a monitoring device of a maintenance engineer when a decrease in braking capability of the brake device is detected.

18. The elevator apparatus according to claim 6, further comprising a brake inspection device configured to automatically inspect the braking capability of the brake device at set timing and to automatically issue an alarm to a monitoring device of a maintenance engineer when a decrease in braking capability of the brake device is detected.

19. The elevator apparatus according to claim 7, further comprising a brake inspection device configured to automatically inspect the braking capability of the brake device at set timing and to automatically issue an alarm to a monitoring device of a maintenance engineer when a decrease in braking capability of the brake device is detected.

20. The elevator apparatus according to claim 8, further comprising a brake inspection device configured to automatically inspect the braking capability of the brake device at set timing and to automatically issue an alarm to a monitoring device of a maintenance engineer when a decrease in braking capability of the brake device is detected.

* * * * *